United States Patent [19]

Swenson

[11] Patent Number: 4,577,360

[45] Date of Patent: Mar. 25, 1986

[54] SHOE TREE

[75] Inventor: Robert D. Swenson, Seattle, Wash.

[73] Assignee: Melvin D. Pountain, Everett, Wash.

[21] Appl. No.: 734,630

[22] Filed: May 15, 1985

Related U.S. Application Data

[63] Continuation-in-part of Ser. No. 653,513, Sep. 21, 1984, abandoned.

[51] Int. Cl.[4] ..... A43D 5/00

[52] U.S. Cl. ..... 12/115.6; 12/114.2; 12/117.4

[58] Field of Search ..... 12/114.2, 115.8, 115.6, 12/117.4, 128 R

[56] References Cited

U.S. PATENT DOCUMENTS

| | | | |
|---|---|---|---|
| D. 163,106 | 5/1951 | Evans | D7/3 |
| 632,776 | 9/1899 | Brooks | 12/115.6 |
| 1,095,917 | 5/1914 | Nickless | 12/115.6 |
| 1,290,879 | 1/1919 | Baruch | 12/115.6 |
| 1,506,519 | 8/1924 | England | 12/115.6 |
| 1,776,831 | 9/1930 | Eddins et al. | 12/115.6 |
| 1,865,117 | 6/1932 | Legge | 12/115.6 |
| 1,928,596 | 9/1933 | Merz | 12/128.1 |
| 2,226,565 | 12/1940 | Kristal | 12/128.1 |
| 2,580,746 | 1/1952 | Feldman | 12/115.6 |
| 2,699,561 | 1/1955 | Mackay | 12/117.4 |
| 2,704,850 | 3/1955 | Solomon | 12/128.1 |
| 2,903,725 | 9/1959 | Zeserson et al. | 12/115.6 |
| 2,941,220 | 6/1960 | Schick | 12/115.6 |
| 3,501,792 | 3/1970 | Merriman | 12/115.6 |
| 3,512,199 | 5/1970 | Messinger | 12/117.4 |
| 4,261,071 | 4/1981 | Forte | 12/115.6 |

FOREIGN PATENT DOCUMENTS

| | | | |
|---|---|---|---|
| 37325 | 11/1930 | France | 12/115.6 |
| 732405 | 4/1932 | France | 12/115.6 |
| 1111727 | 3/1956 | France | 12/115.6 |
| 612932 | 11/1948 | United Kingdom | 12/115.6 |

*Primary Examiner*—Werner H. Schroeder
*Assistant Examiner*—Steven N. Meyers
*Attorney, Agent, or Firm*—Joan H. Pauly

[57] ABSTRACT

This invention is directed toward providing a shoe tree that is attractive and relatively lightweight, inexpensive, and easy to use. Shoe tree (4, 4') includes an integral molded plastic body (6, 6') and a flat metal spring (8, 8'). Body (6, 6') has a center portion (14, 14') that defines a downwardly facing channel (30, 30') which receives the main portion (15) of spring (8, 8'). Portion (15) is slidably held in place by retainer elements (32) projecting into channel (30, 30') from sidewalls (26) of center portion (14, 14'). Sidewalls (26) have vertical slots (28) to provide flexibility. Center portion (14, 14') connects toe and heel portions (10, 10', 12, 12') of body (6, 6'). One end (16, 16') of spring (8, 8') has a hole (18, 18') and is heat staked onto a peg (38, 38') projecting from center portion (14') in one embodiment and from toe portion (10) in the other embodiment. The other end (20) of spring (8, 8') slides freely into heel portion (12, 12').

16 Claims, 11 Drawing Figures

SHOE TREE

RELATED APPLICATION

This is a continuation-in-part of application Ser. No. 653,513, filed on Sept. 21, 1984, abandoned.

TECHNICAL FIELD

This invention relates to shoe trees and, more particularly, to a shoe tree which has an integral plastic body with a center portion between toe and heel portions for positioning a flat spring, said center portion being easily grasped by a user and having slots to provide flexibility.

BACKGROUND ART

Shoe trees in general have been well-known for at least several decades. Until relatively recently, most shoe trees were made from solid pieces of wood. Shoe trees constructed in this manner had a number of disadvantages, including being relatively expensive and quite heavy. In addition, many of these shoe trees were fairly complex and relatively difficult to use.

Each of the following U.S. patents discloses a shoe tree: U.S. Pat. Nos. 1,095,917, granted May 5, 1914, to W. A. Nickless; 1,290,879, granted Jan. 14, 1919, to S. Baruch; 1,776,831, granted Sept. 30, 1930, to S. A. Eddins et al.; 1,928,596, granted Sept. 26, 1933, to F. Merz; 2,226,565, granted Dec. 31, 1940, to R. M. Kristal; 2,704,850, granted Mar. 29, 1955, to L. Solomon; 2,941,220, granted June 21, 1960, A. L. Schick; 4,261,071, granted Apr. 14, 1981, to R. M. Forte; and U.S. Pat. No. Des. 163,106, granted May 1, 1951, to T. A. Evans.

Merz, Kristal, Solomon, Schick, and Evans each disclose a shoe tree having separate toe and heel members connected by a coil-type spring. Nickless and Baruch each disclose a shoe tree having separate toe and heel members connected by a flat spring.

Forte discloses a shoe tree having an integral hollow body with heel and toe portions connected by a bellows. The bellows permits longitudinal expansion and compression and some twisting of the shoe tree. The hollow body is formed by a blow-molding process.

Eddins et al. disclose a shoe tree having a separate toe piece connected to one end of a flat spring. The other end of the spring is formed into a loop to provide a surface for abutting the heel of a shoe. The spring is provided with a flat upper cover of plastic that is rivoted to the spring at intervals and covers the upper surface and the loop of the spring. At the more forward rivet locations, the cover is slotted to allow movement of the cover with respect to the spring. The spring, but not the cover, is attached to the toe piece.

The above patents and the prior art that is discussed and/or cited therein should be studied for the purpose of putting the present invention into proper perspective relative to the prior art.

DISCLOSURE OF THE INVENTION

This invention is directed toward providing an improved shoe tree. According to an aspect of the invention, the shoe tree comprises a body and a flat spring. The body includes a toe portion, a heel portion, and a center portion connecting the toe and heel portions. The spring includes a main portion and first and second opposite end portions. The center portion of the body is dimensioned to be easily grasped by a user of the shoe tree. The center portion has wall means defining a downwardly facing channel for receiving the main portion of the spring. This wall means has a plurality of slots extending therethrough. The slots are dimensioned and positioned to give the center portion a predetermined amount of flexibility. The wall means also has means for slidably holding the main portion of the spring in position in the channel. The body has first and second engaging means for engaging the first and second end portions of the spring, respectively. The first engaging means includes means for allowing the first end portion of the spring to slide longitudinally.

In the first preferred embodiment, the heel portion of the body is hollow, and the means for allowing said first end portion to slide includes a forwardly opening cavity which is formed by said heel portion and into which said first end portion slides. In the second preferred embodiment, the means for allowing the first end portion of the spring to slide includes passageway means for slidably receiving such end portion.

A preferred feature of the shoe tree is the provision of a hole extending through the second end portion of the spring, and second engaging means that includes a peg projecting from a surface of the body and through such hole. The peg has an enlarged diameter outer portion for preventing the peg from sliding out of the hole. Preferably, the wall means includes a generally horizontal top portion and two side portions depending downwardly from opposite side edges of the top portion to form therewith said channel for receiving the main portion of the spring, and the peg projects generally downwardly from the top portion and is spaced rearwardly from the rear end of the toe portion and the front edge of the spring. This positioning of the peg has the advantage of ensuring that the center portion of the body forms a smooth rounded curve when it is flexed.

According to a preferred aspect of the invention, the means for slidably holding the main portion of the spring in position in the channel includes retainer elements carried by the wall means and projecting into the channel to abut a lower surface of the main portion of the spring. Preferably, the body is a single, integral molded plastic member, and the retainer elements are an integral part of this member. When the second engaging means includes a peg, the peg is preferably also an integral part of this member.

According to another aspect of the invention, the wall means includes a generally horizontal top portion, and two side portions depending downwardly from opposite side edges of the top portion to form, with the top portion, the downwardly facing channel. Preferably, the slots include a plurality of longitudinally spaced, generally vertical slots extending laterally through each side portion substantially from the top portion to a bottom edge of the side portion. Also preferably, the means for slidably holding the main portion of the spring in position in the channel includes retainer elements carried by the side portions and projecting into the channel. Each of the retainer elements has a generally vertical cam surface and an upwardly facing retainer shoulder.

Shoe trees constructed according to the invention have a unique combination of advantages. Each of these advantages is maximized without sacrificing any of the other advantages. Shoe trees made in accordance with the invention are relatively simple in construction and inexpensive to manufacture. Shoe trees of the invention are also durable and reliable, further adding to cost savings by users. The structure of the shoe trees of the invention provides a lightweight product that is attractive and easy to use. In addition, shoe trees of the invention are quite versatile, with their light weight making them highly suitable for both home use and travel.

These and other advantages and features will become apparent from the detailed description of the best modes for carrying out the invention that follows.

BRIEF DESCRIPTION OF THE DRAWINGS

In the drawings, like element designations refer to like parts throughout, and.

BEST MODE FOR CARRYING OUT THE INVENTION

Figure 1:
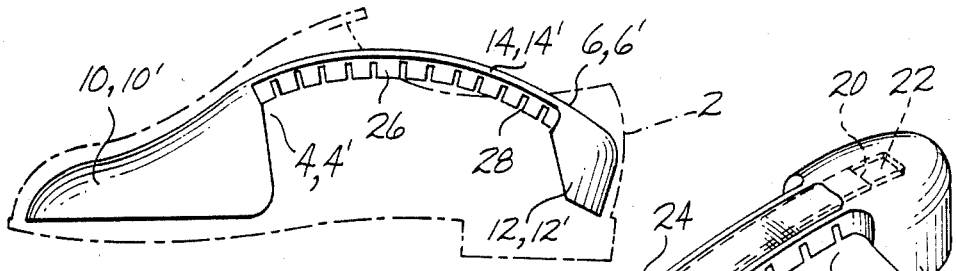
FIG. 1 is an elevational view of either preferred embodiment of the shoe tree in use in a shoe, with the shoe shown in phantom.

The drawings show two embodiments of a shoe tree 4, 4' that are constructed according to the invention and that also constitute the best modes of the invention currently known to the applicant. FIG. 1 illustrates the shoe tree 4, 4' in use to retain the shape of a shoe 2, shown in phantom. The shoe tree 4, 4' has two components, an integral molded plastic body 6, 6' and a flat metal spring 8, 8'.

The body 6, 6' has a toe portion 10, 10' and a heel portion 12, 12'. The toe portion 10, 10' is contoured to substantially conform to the shape of the inside of the toe portion of a shoe 2. The heel portion 12, 12' has a generally vertical back surface that abuts the inside of the generally vertical back of the shoe 2. The manner in which the toe and heel portions 10, 10', 12, 12' engage the inner surfaces of the shoe 2 is illustrated in FIG. 1.

The body 6, 6' of the shoe tree 4, 4' also includes a center portion 14, 14' which connects the toe and heel portions 10, 10' 12, 12'. Preferably, all three portions 10, 12, 14, 10', 12', 14' are molded in a single operation into a single integrated plastic body 6, 6'. Various types of plastics may be used for forming the body 6, 6'. The preferred type of plastic is a polyethylene plastic that is sufficiently flexible to permit the shoe tree 4, 4' to be placed inside of and removed from a shoe 2 and to permit the shoe tree 4, 4' to adjust to shoes of different sizes.

Center portion 14, 14' is dimensioned to be easily grasped by a user of the shoe tree 4, 4'. The walls 24, 24', 26 of the center portion 14, 14' define a downwardly facing channel 30, 30' for receiving the main portion 15 of the spring 8, 8'. The center portion 14, 14' includes a generally horizontal top wall 24, 24' and two sidewalls 26 that depend downwardly from opposite side edges of the top wall 24, 24'. The top wall 24, 24' and sidewalls 26 together form the channel 30, 30'.

Each of the sidewalls 26 is provided with a plurality of longitudinally spaced, generally vertical slots 28. Each slot 28 extends laterally through its respective sidewall 26 substantially from the top wall 24, 24' to the bottom edge of the respective sidewall 26. As can be seen in FIGS. 1–3, 5, and 11, the bottom end of each slot 28 opens onto the bottom edge of the respective sidewall 26. The slots 28 are dimensioned and positioned to give the center portion 14, 14' of the body 6, 6' a predetermined amount of flexibility. This predetermined amount of flexibility is chosen to be sufficient to allow the shoe tree 4, 4' to be easily used and to adjust to different size shoes, without sacrificing sufficient strength to maintain the durability of the shoe tree 4, 4'.

The spring 8, 8' that is carried by the body 6, 6' is basically a simple flat spring made from a strong material, such as stainless steel. The spring 8, 8' has a main portion 15 that extends between two opposite end portions 16, 16' and 20. The main portion 15 is slidably held in position in the channel 30, 30' by means described below. The two end portions 16, 16', 20 of the spring 8, 8' are engaged by engaging means carried by the body 6, 6'. At least one of the end portions 16, 16', 20 of the spring 8, 8' is free to slide longitudinally.

The main center portion 15 of the spring 8, 8', as noted above, is received into the channel 30, 30'. In the assembled shoe tree 4, 4' the top surface of the spring 8, 8' is closely adjacent to the inner bottom surface of the top wall 24, 24' of the center portion 14, 14' of the body 6, 6'. The main portion 15 is slidably held in position by retainer elements 32 carried by the sidewalls 26 of the center portion 14, 14'. These retainer elements 32 can best be seen in FIGS. 4–7, 10, and 11. Each element 32 projects into the channel 30, 30'. Each element 32 has a generally vertical cam surface 34 and an upwardly facing horizontal retainer shoulder 36. When the spring 8, 8' is in position in the assembled shoe tree 4, 4', each retainer shoulder 36 abuts the lower surface of the main portion 15 of the spring 8, 8' as shown in FIG. 6.

Figures 4, 5, 6, 7, 8, 9:
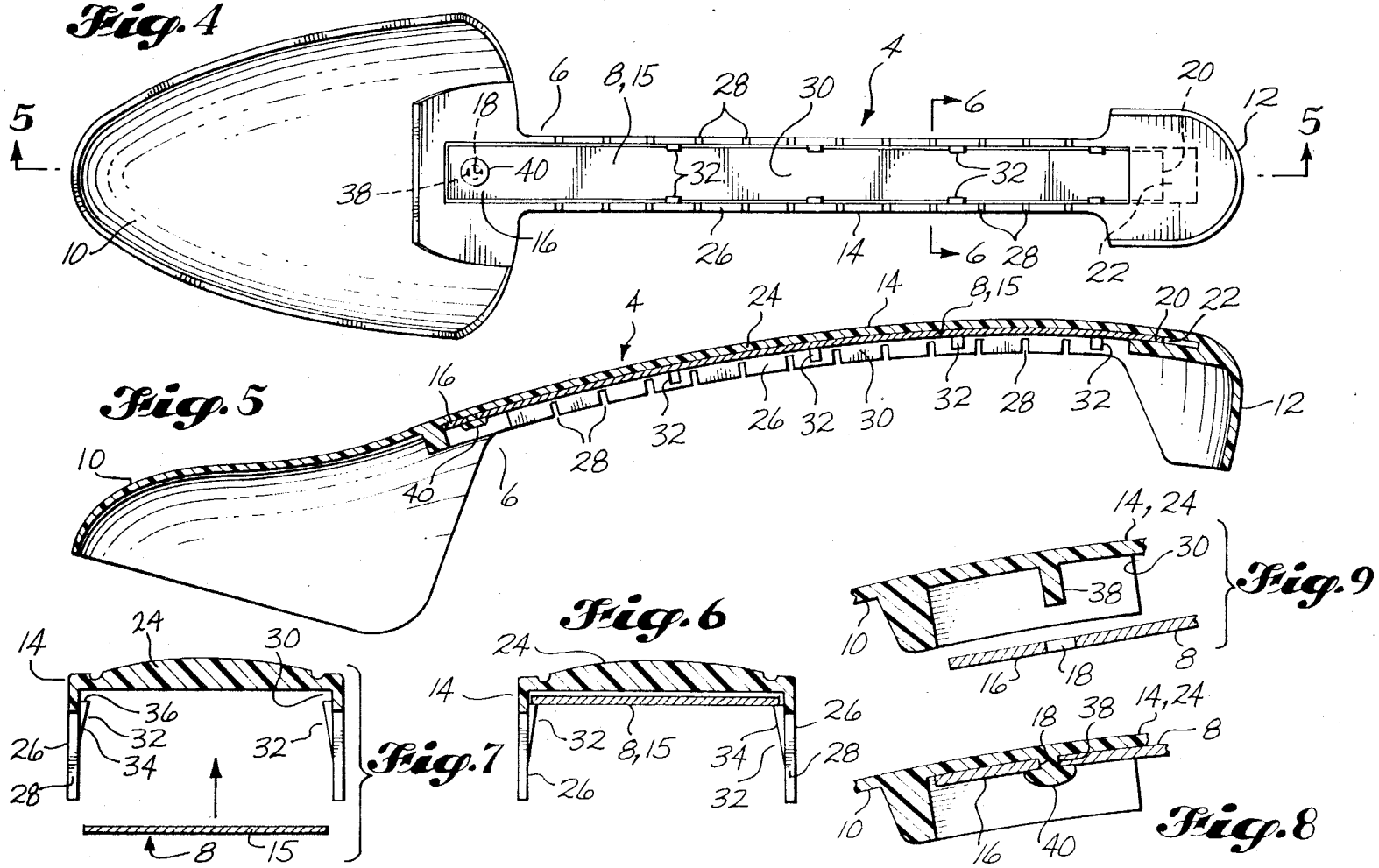
FIG. 4 is a bottom plan view of the shoe tree shown in FIGS. 2 and 3.
FIG. 5 is a sectional view taken along the line 5—5 in FIG. 4.
FIG. 6 is a sectional view taken along the line 6—6 in FIG. 4.
FIG. 7 is like FIG. 6 except that it shows the spring separate from the body.
FIG. 8 is an enlarged framentary view of the portion of FIG. 5 showing the front end of the spring.
FIG. 9 is like FIG. 8 except that it shows the same portion of the shoe tree before assembly.

FIG. 7 shows the spring 8, 8' separate from the body 6, 6' and illustrates the introduction of the main portion 15 of the spring 8, 8' into the channel 30, 30'. As indicated by the arrow in FIG. 7, the main portion 15 is moved upwardly (as shown) into the channel 30, 30'. The sidewalls 26 have sufficient flexability so that, as the side edges of the main portion 15 engage the cam surfaces 34, the sidewalls 26 move outwardly an amount sufficient to permit the main portion 15 to move past retainer elements 32 into position above elements 32. The assembled position is best shown in FIGS. 5, 6, and 11.

Figure 2:
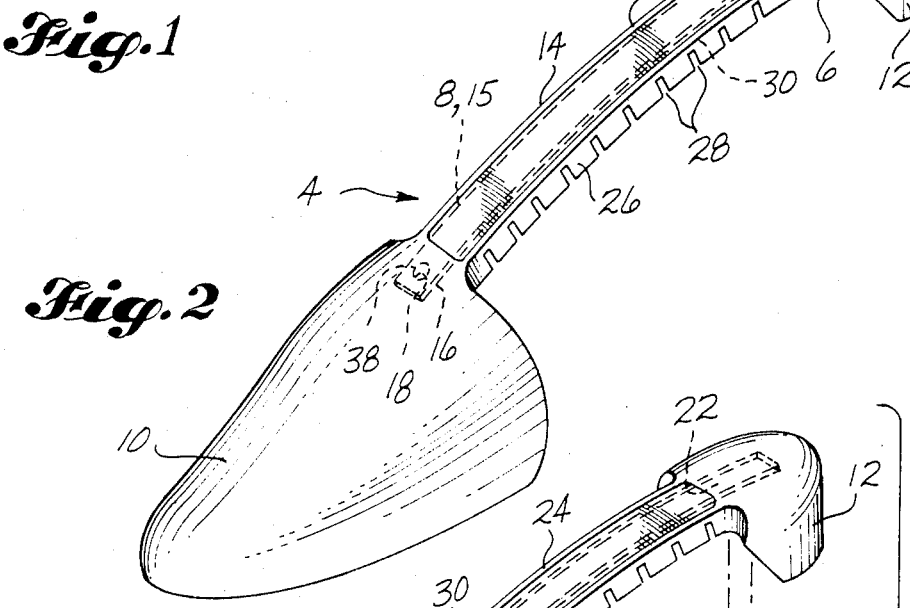
FIG. 2 is a pictorial view of the second preferred embodiment of the shoe tree.
Figure 3:
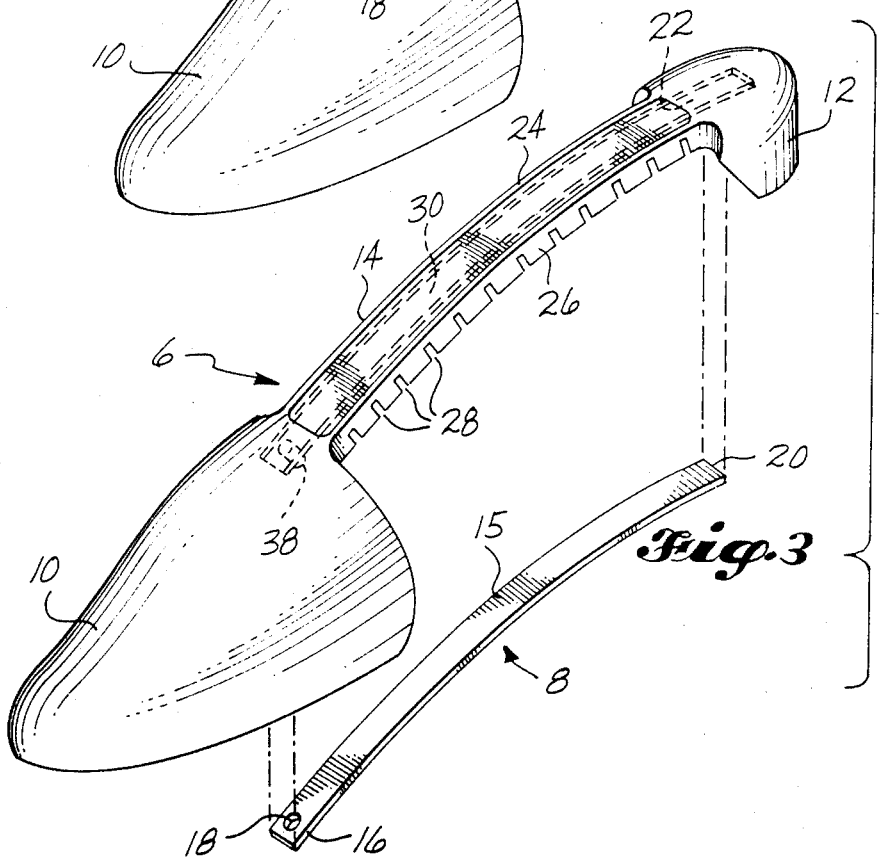
FIG. 3 is an exploded pictorial view of the shoe tree shown in FIG. 2.
Figures 10, 11:
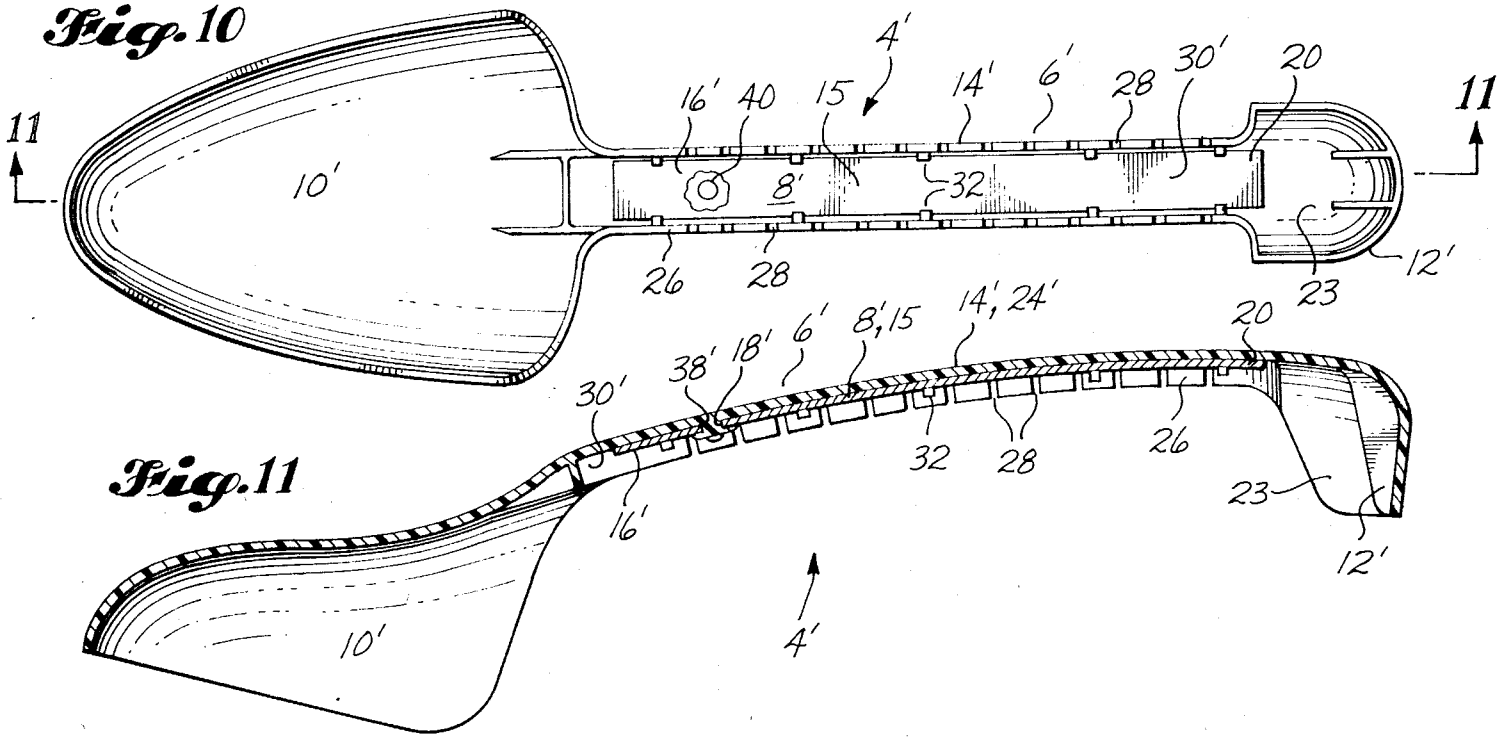
FIG. 10 is a bottom plan view of the first preferred embodiment of the shoe tree.
FIG. 11 is a sectional view taken along the line 11—11 in FIG. 10.

One end portion 16, 16' of the spring 8, 8' has a hole 18, 18' extending therethrough, as shown in FIGS. 3, 5, and 11. The body 6, 6' has a peg 38, 38' projecting from an inner lower surface for engaging the peg 38, 38'. In the first preferred embodiment shown in FIGS. 10 and 11, the peg 38' projects generally downwardly from the top wall 24' of center portion 14' and is spaced about one inch rearwardly from the rear end of the toe portion 10' and the front edge of the spring 8'. In the second preferred embodiment shown in FIGS. 2–5, the peg 38 projects from the toe portion 10. FIG. 9 illustrates the end 16 of the spring 8 and the peg 38 before assembly of the second embodiment of the shoe tree 4. When the shoe tree 4 is assembled, the peg 38 is placed into and through the hole 18 in spring end 16. When end 16 is in position abutting the inner surface of toe portion 10, peg 38 is heat staked to form an enlarged diameter peg head 40 that prevents the peg 38 from sliding out of the hole 18 and spring end 16 from moving out of position. The peg 38 and head 40 after the heat staking operation are best seen in FIG. 8. The assembly of the first embodiment shown in FIGS. 10 and 11 is carried out in the same manner.

The other end portion 20 of the spring 8, 8′ is engaged by the heel portion 12, 12′ of the plastic body 6, 6′. In the second embodiment shown in FIGS. 2–5, end 20 is engaged by portion 12 by being slidably received into a passageway 22 formed in portion 12. The sliding engagement of end 20 and passageway 22 is best seen in FIGS. 2, 4, and 5. In the first embodiment shown in FIGS. 10 and 11, the passageway 22 is eliminated, and the end portion 20 slides into the forwardly and downwardly opening cavity 23 formed by the hollow heel portion 12′. The engagement of the end portion 20 by the rearwardmost pair of retainer elements 32 and the top wall of cavity 23 is sufficient to maintain end portion 20 in proper position. The elimination of the passageway simplifies and reduces the cost of manufacture. Although in the embodiments shown in the drawings the peg 38, 38′ engages the front end of the spring 8, 8′ and the heel portion 12, 12′ engages the rear end of the spring 8, 8′, it is of course to be understood that this could be reversed, with the peg engaging the rear end and the front end being slidable, without departing from the spirit and scope of the invention and without affecting the functioning of the shoe tree of the invention.

In the preferred embodiments of the shoe tree 4, 4′ the body 6, 6′ is a single, integral injection molded plastic member. Retainer elements 32 and the peg 38, 38′ are each an integral part of this single molded plastic member. The retainer elements 32 and peg 38, 38′ are formed on the body 6, 6′ when the body 6, 6′ is molded. The passageway 22 in the heel portion 12 of the second embodiment is also formed during the molding process. This single step injection molding process allows the body 6, 6′ to be manufactured relatively easily and inexpensively.

The assembly of the two components 6, 6′ and 8, 8′ of the shoe tree 4, 4′ is also easy and inexpensive to carry out, further adding to the economic advantages of the design of the shoe tree 4, 4′. All that is required to assemble the shoe tree 4, 4′ is to slide the spring end 20 into passageway 22 (this step is eliminated in the first embodiment), press the main portion 15 of spring 8, 8′ past retainer elements 32 into position in channel 30, 30′, slide spring end 16, 16′ over peg 38, 38′, and heat stake peg 38, 38′ to form peg head 40. This simple assembly process can be carried out quickly and with a very minimum amount of skill.

As noted above, the shoe tree of the invention is highly versatile and is suitable for use both at home and during travel. In the preferred embodiments of the shoe tree 4, 4′ shown in the drawings, both the toe and heel portions 10, 10′, 12, 12′ are essentially hollow members. See in particular FIGS. 5 and 11. This hollow configuration of portions 10, 10′, 12, 12′ helps to minimize the weight of the shoe tree 4, 4′ and to minimize the cost of the materials used in the manufacture of shoe tree 4, 4′. The minimized weight of the shoe tree 4, 4′ is especially advantageous during travel. The user can keep his shoes in shape and protect them from damage during travel without having to carry any significant additional weight.

The design of the shoe tree is also quite attractive. The appearance of the slotted center portion 14, 14′ of the body 6, 6′ is a considerable improvement over the bare spring arrangements of many known shoe trees. In addition, the molded plastic body 6, 6′ may easily be made in a large variety of colors to suit the particular needs and tastes of a corresponding variety of users.

Throughout the description of the structure, use, and manufacture of the preferred embodiment of the shoe tree of the invention, the terms "top", "downwardly", "horizontal", and the like have been used. These terms have been used for illustrative purposes only, illustrating a typical use attitude of the shoe tree, as shown in FIG. 1. The terms are not intended to indicate that the use attitude of the shoe tree of the invention is limited to the horizontal position shown in FIG. 1. It is intended to be understood that the shoe tree of the invention may be used to advantage in other use attitudes, such as in a shoe that is placed on a shoe rack in a generally vertical position.

It will be obvious to those skilled in the art to which this invention is addressed that the invention may be used to advantage in a variety of situations. Therefore, it is also to be understood by those skilled in the art that various changes, modifications, and omissions in form and detail may be made witout departing from the spirit and scope of the invention as defined by the following claims.

What is claimed is:

1. A shoe tree comprising a body including a toe portion, a heel portion, and a center portion connecting said toe and heel portions; and a flat spring including a main portion, and first and second opposite end portions; said center portion of the body being dimensioned to be easily grasped by a user of the shoe tree and having wall means defining a downwardly facing channel for receiving said main portion of the spring; said wall means having a plurality of slots extending therethrough and dimensioned and positioned to give said center portion a predetermined amount of flexibility, and means for slidably holding said main portion in position in said channel; said body having first and second engaging means for engaging said first and second end portions of the spring, respectively; and said first engaging means including means for allowing the first end portion of the spring to slide longitudinally.

2. A shoe tree as described in claim 1, in which said wall means includes a generally horizontal top portion, and two side portions depending downwardly from opposite side edges of said top portion to form therewith said channel.

3. A shoe tree as described in claim 2, in which said slots include a plurality of longitudinally spaced, generally vertical slots extending laterally through each side portion substantially from said top portion to a bottom edge of the side portion.

4. A shoe tree as described in claim 3, in which the means for slidably holding said main portion of the spring in position in said channel includes retainer elements carried by said side portions and projecting into said channel, each such retainer element having a generally vertical cam surface and an upwardly facing retainer shoulder.

5. A shoe tree as described in claim 4, in which the body is a single, integral molded plastic member; said retainer elements are an integral part of said member; the heel portion of the body is hollow, and the means for allowing said first end portion to slide includes a forwardly opening cavity which is formed by said heel portion and into which said first end portion slides; said second end portion of the spring has a hole extending therethrough; and the second engaging means includes a peg that projects from and is an integral part of said member, that projects through said hole, and that has an enlarged diameter outer portion for preventing said peg from sliding out of said hole.

6. A shoe tree as described in claim 4, in which the means for allowing said first end portion to slide includes passageway means for slidably receiving said first end portion.

7. A shoe tree as described in claim 4, in which the body is a single, integral molded plastic member; said retainer elements are an integral part of said member; the means for allowing said first end portion to slide includes passageway means formed by portions of said member for slidably receiving said first end portion; said second end portion of the spring has a hole extending therethrough; and the second engaging means includes a peg that projects from and is an integral part of said member, that projects through said hole, and that has an enlarged diameter outer portion for preventing said peg from sliding out of said hole.

8. A shoe tree as described in claim 4, in which the heel portion of the body is hollow, and the means for allowing said first end portion to slide includes a forwardly opening cavity which is formed by said heel portion and into which said first end portion slides.

9. A shoe tree as described in claim 1, in which the means for slidably holding said main portion of the spring in position in said channel includes retainer elements carried by said wall means and projecting into said channel to abut a lower surface of said main portion of the spring.

10. A shoe tree as described in claim 9, in which the body is a single, integral molded plastic member; said retainer elements are an integral part of said member; said second end portion of the spring has a hole extending therethrough; and the second engaging means includes a peg that projects from and is an integral part of said member, that projects through said hole, and that has an enlarged diameter outer portion for preventing said peg from sliding out of said hole.

11. A shoe tree as described in claim 9, in which the body is a single, integral molded plastic member; said retainer elements are an integral part of said member; the means for allowing said first end portion to slide includes passageway means formed by portions of said member for slidably receiving said first end portion; said second end portion of the spring has a hole extending therethrough; and the second engaging means includes a peg that projects through said hole, and that has an enlarged diameter outer portion for preventing said peg from sliding out of said hole.

12. A shoe tree as described in claim 9, in which the heel portion of the body is hollow, and the means for allowing said first end portion to slide includes a forwardly opening cavity which is formed by said heel portion and into which said first end portion slides.

13. A shoe tree as described in claim 1, in which said second end portion of the spring has a hole extending therethrough; and the second engaging means includes a peg projecting from a surface of the body and through said hole, said peg having an enlarged diameter outer portion for preventing said peg from sliding out of said hole.

14. A shoe tree as described in claim 13, in which said wall means includes a generally horizontal top portion, and two side portions depending downwardly from opposite side edges of said top portion to form therewith said channel; and said peg projects generally downwardly from said top portion and is spaced rearwardly from the rear end of the toe portion and the front edge of the spring.

15. A shoe tree as described in claim 14, in which the body is a single, integral molded plastic member; and said peg is an integral part of said member.

16. A shoe tree as described in claim 1, in which the means for allowing said first end portion to slide includes passageway means for slidably receiving said first end portion.

* * * * *

UNITED STATES PATENT AND TRADEMARK OFFICE

CERTIFICATE OF CORRECTION

PATENT NO. : 4,577,360

DATED : March 25, 1986

INVENTOR(S) : Robert D. Swenson

It is certified that error appears in the above-identified patent and that said Letters Patent are hereby corrected as shown below:

Claim 11, column 8, line 14, after "projects", insert -- from and is an integral part of said member, that projects --.

Signed and Sealed this

*Twenty-second* Day of *July 1986*

[SEAL]

*Attest:*

DONALD J. QUIGG

*Attesting Officer*

*Commissioner of Patents and Trademarks*